US009643407B2

(12) United States Patent
Toussaint et al.

(10) Patent No.: US 9,643,407 B2
(45) Date of Patent: May 9, 2017

(54) WARMING PRINTHEADS DURING PRINT PASSES

(71) Applicant: Hewlett-Packard Development Company, L.P., Houston, TX (US)

(72) Inventors: David Toussaint, Barcelona (ES); Oriel Borrell Avila, Sabadell (ES); Antonio Gracia Verdugo, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/787,467

(22) PCT Filed: Jul. 25, 2013

(86) PCT No.: PCT/US2013/052028
§ 371 (c)(1),
(2) Date: Oct. 27, 2015

(87) PCT Pub. No.: WO2015/012837
PCT Pub. Date: Jan. 29, 2015

(65) Prior Publication Data

US 2016/0107437 A1 Apr. 21, 2016

(51) Int. Cl.
*B41J 29/393* (2006.01)
*B41J 2/045* (2006.01)
(Continued)

(52) U.S. Cl.
CPC ..... *B41J 2/04528* (2013.01); *B41J 2/0454* (2013.01); *B41J 2/0458* (2013.01);
(Continued)

(58) Field of Classification Search
CPC ... B41J 2/365; B41J 2/3556; B41J 2/38; B41J 2/04528; B41J 2/0454; B41J 2/04563; B41J 2/0458
See application file for complete search history.

(56) References Cited

U.S. PATENT DOCUMENTS 5,475,405 A 12/1995 Widder et al.
6,283,650 B1 * 9/2001 Yamada ..... B41J 2/04541 347/14

(Continued)

FOREIGN PATENT DOCUMENTS

GB 2404767 A * 2/2005 ..... B41J 2/0454

OTHER PUBLICATIONS

Lee, K.I. et al.; "Multi Nozzle Electrohydrodynamic Inkjet Printing Head By Batch Fabrication", MEMS, Jan. 20-24, 2013, pp. 1165-1168, Taipei, Taiwan.

(Continued)

*Primary Examiner* — Julian Huffman
(74) *Attorney, Agent, or Firm* — HP Inc-Patent Department

(57) ABSTRACT

A drive signal may be determined to drive a printhead to a series of target temperatures during respective portions of a print pass by the printhead. Each of the target temperatures may be the greater of a temperature of the printhead caused by printing a quantity of printing fluid to be printed during the respective portion and a predetermined threshold temperature. A drive signal may be provided to warm the printhead to the series of target temperatures during the respective portions of the print pass.

19 Claims, 4 Drawing Sheets

(51) Int. Cl.
*B41J 2/365* (2006.01)
*B41J 2/38* (2006.01)

(52) U.S. Cl.
CPC ..... *B41J 2/04563* (2013.01); *B41J 2/365* (2013.01); *B41J 2/38* (2013.01)

(56) References Cited

U.S. PATENT DOCUMENTS

| | | | |
|---|---|---|---|
| 7,246,876 | B2 | 7/2007 | Silverbrook et al. |
| 8,087,766 | B2 | 1/2012 | Barreto et al. |
| 2006/0028502 | A1 | 2/2006 | Lee et al. |
| 2006/0038848 | A1 | 2/2006 | Liao et al. |
| 2007/0229567 | A1 | 10/2007 | Hayashi et al. |
| 2008/0083744 | A1 | 4/2008 | Ruiz et al. |
| 2011/0063374 | A1 | 3/2011 | Rea et al. |
| 2011/0085003 | A1 | 4/2011 | Oonuki et al. |

OTHER PUBLICATIONS

PCT International Search Report and Written Opinion, Apr. 23, 2014, Korean Intellectual Property Office, PCT Patent Application No. PCT/US2013/052028, 11 pages.

* cited by examiner

WARMING PRINTHEADS DURING PRINT PASSES

CROSS-REFERENCE TO RELATED APPLICATION

This application is a U.S. National Stage Application of and claims priority to International Patent Application No. PCT/US2013/052028, filed on Jul. 25, 2013, and entitled "WARMING PRINTHEADS DURING PRINT PASSES," which is hereby incorporated by reference in its entirety.

BACKGROUND

Inkjet printing allows recording images on substrates. Inkjet printing may allow for low printer noise, high-speed recording, multi-color recording, and low prices to consumers. Examples of inkjet printers include thermal inkjet printers and piezo inkjet printers.

BRIEF DESCRIPTION OF THE DRAWINGS

Some examples are described with respect to the following figures.

DETAILED DESCRIPTION

Figure 1:
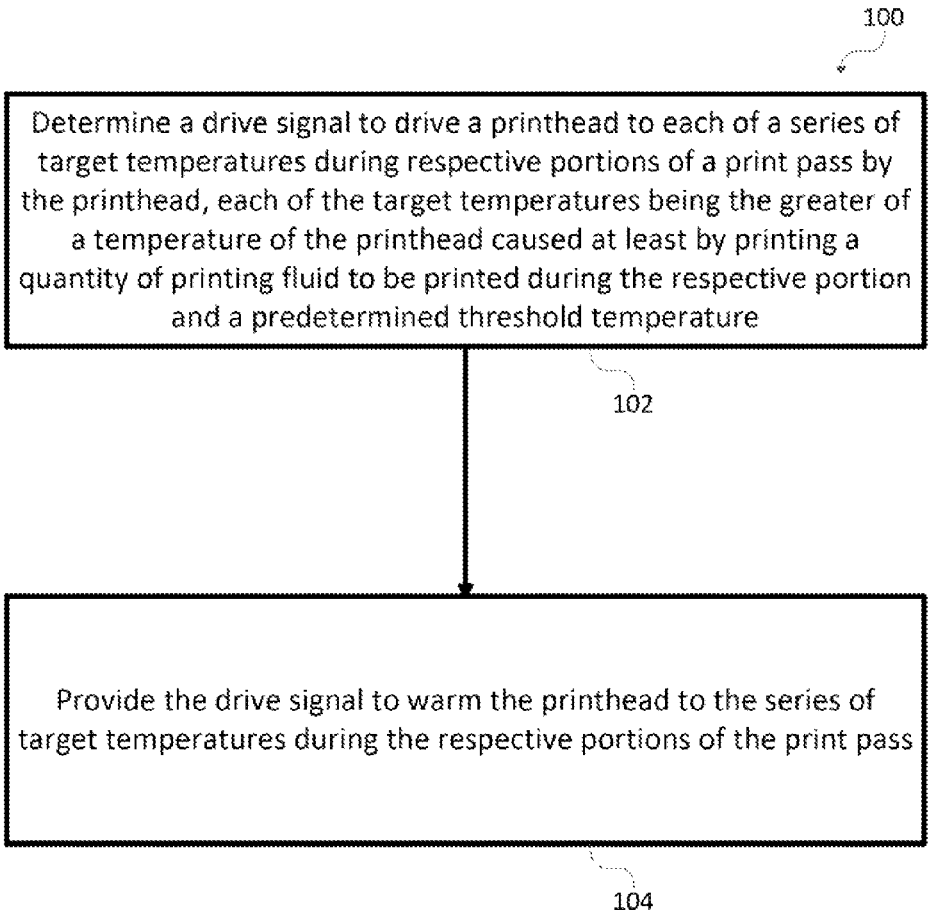
FIG. 1 is a flow diagram illustrating a method of reducing decap of printing fluid according to some examples.

Before particular examples of the present disclosure are disclosed and described, it is to be understood that this disclosure is not limited to the particular examples disclosed herein as such may vary to some degree. It is also to be understood that the terminology used herein is used for the purpose of describing particular examples only and is not intended to be limiting, as the scope of the present disclosure will be defined only by the appended claims and equivalents thereof.

Notwithstanding the foregoing, the following terminology is understood to mean the following when recited by the specification or the claims. The singular forms 'a,' 'an,' and 'the' are intended to mean 'one or more.' For example, 'a part' includes reference to one or more of such a 'part' Further, the terms 'including' and 'having' are intended to have the same meaning as the term 'comprising' has in patent law.

Some printing fluids, such as water-based pigmented inks, may be affected by a phenomenon known as 'decap', which when recited by the specification or the claims is understood to mean the inability of printing fluid to remain fluid upon exposure to air, thereby potentially leading to degradation of print quality. For example, printing fluid, such as ink, may crust on nozzles of a printhead during periods of a print pass in which the ink is not being ejected by the nozzles. 'Decap time' when recited by the specification or the claims is understood to mean the time period in which the printing fluid's viscosity at a nozzle increases to a threshold sufficient to cause the ejection to fail and cause the nozzle to clog.

Accordingly, the present disclosure concerns printing systems, printers, printheads, computer readable storage media, and methods of reducing decap of the printing fluid by warming a printhead and thus its printing fluid during a print pass. By warming the printhead during the print pass based on target temperatures that may be predictively provided before printing the print pass, the decap time of the printing fluid may be increased, and thus decap of the printing fluid may be reduced and/or prevented in any print mode. For example, the decap time may be increased sufficiently that the decap time may be greater than a time elapsed between ejections of printing fluid by a nozzle, thereby reducing and/or preventing decap. Additionally, decap may be preemptively reduced and/or prevented during the early portions of the print pass by warming the printhead to the predictively provided target temperatures during the early portions, in which initial droplets of printing fluid may be ejected.

Reduction and/or prevention of decap may be accomplished without causing image quality defects on a plot, without reducing print area on the substrate, without adding any additional work for a user such as cutting the substrate, and without requiring extra servicing such as additional cost per copy or printer cost due to extra hardware such as an extra spittoon. Moreover, the warming may only need to be used as needed to reduce decap, thus printhead life may not be compromised.

Figure 2:
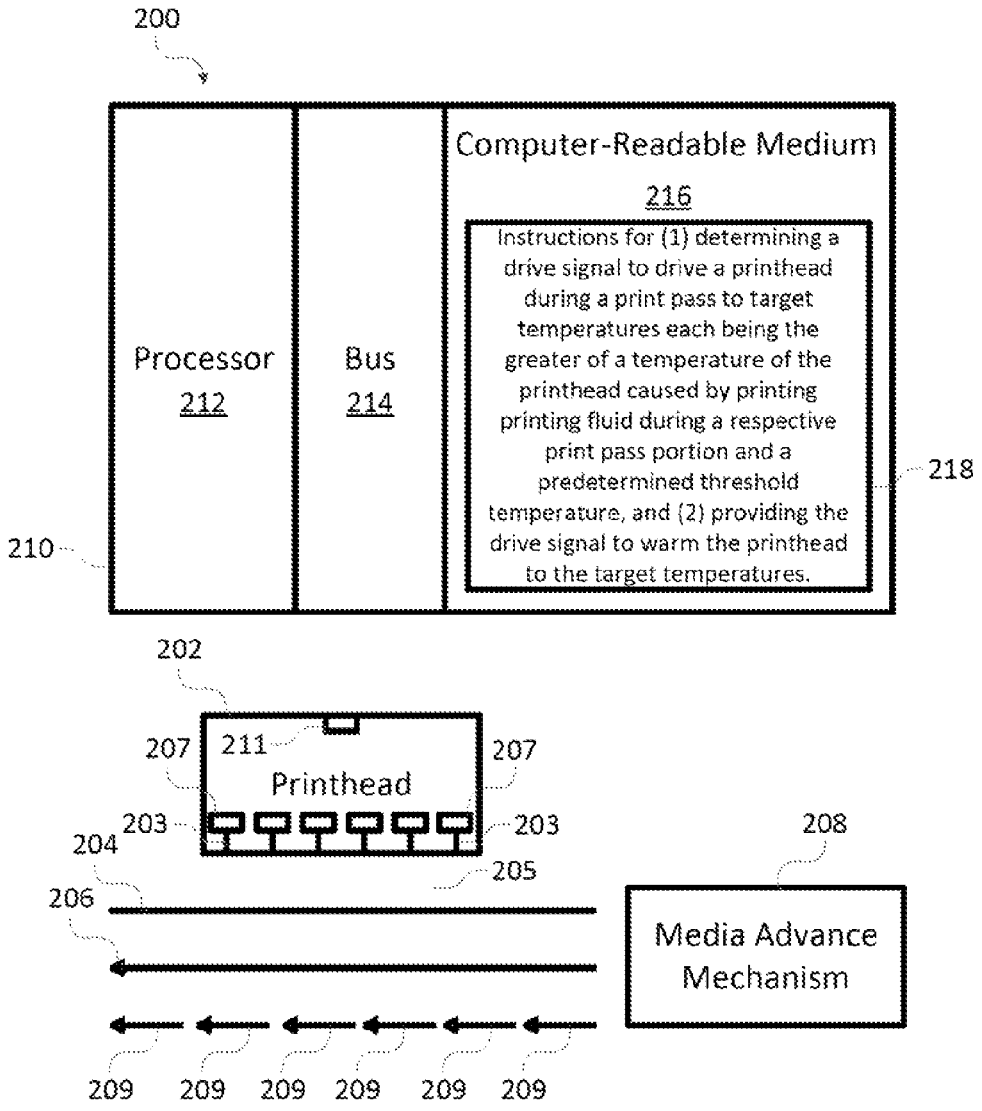
FIG. 2 is a simplified illustration of a printing system according to some examples.

FIG. 1 is a flow diagram illustrating a method 100 according to some examples. The method 100 may begin at block 102. At block 102, at least one drive signal may be determined to drive a printhead to each of a series of target temperatures during respective portions of a print pass by the printhead. Each of the target temperatures may be the greater of a temperature of the printhead caused by printing a quantity of printing fluid to be printed during the respective portion and a predetermined threshold temperature. The method 100 may proceed from block 102 to block 104. At block 104, at least one drive signal may be provided to warm the printhead to the series of target temperatures during the respective portions of the print pass. The method 100 may conclude at block 104, FIG. 2 is a simplified illustration of a printing system 200 according to some examples. The printing system 200 may be or include a printer such as an inkjet printer. In other examples, some of the elements of the printing system 200 may include elements of a printer in addition to elements external to the printer. The printing system 200 may include one or multiple printheads 202, a media advance mechanism 208, and a printer controller 210. The printhead 202 may be used for printing on a substrate 204. The substrate 204 may be a sheet of substrate 204, or may be a web, or roll, of substrate 204. The substrate 204 may be advanced, e.g. longitudinally advanced, through a print zone 205 by a media advance mechanism 208 to complete a print pass 206 that may include a series of portions 209. The print pass 206 and its portions 209 may advance in the direction shown by the arrows of FIG. 2. In some examples, the media advance mechanism 208 may include one or multiple rollers. In other examples, the media advance mechanism 208 may include a transport belt or other suitable media advance device. A printed swath may be generated in one or in multiple print passes 206 of the printheads 202 across the substrate 204.

The printheads 202 may be one or multiple inkjet printheads. In some examples, the printheads 202 may be thermal inkjet printheads. In other examples, the printheads 202 may be piezo inkjet printheads. Each printhead 202 may include an array of printhead nozzles 203 through which drops of printing fluid may be selectively ejected. In some examples, the nozzles 203 may be arranged and spaced apart as a two-dimensional grid. The arrangement and spacing of the nozzles 203 in the printhead may define a printing resolution of the printing system 200 In some examples, the nozzles 203 may be arranged to allow the printing system 200 to print at resolutions of up to 600 dots per inch (DPI). In other examples, the nozzles may be arranged to allow the printing system 200 to print at other higher or lower resolutions, such as 300 DPI and 1200 DPI. The resolution of the printing system 200 together with the width of the substrate may be printed on defines the number of pixel locations on a substrate 204 that may be printable across the width of the substrate 204.

The printheads 202 may include an array of heating units 207 such as resistors. Each of the printhead nozzles 203 may located adjacent to a corresponding heating unit 207. In examples where the printheads 202 are thermal inkjet printheads, the printheads 202 may include chambers, each of which may contain a heating unit 207 and printing fluid, and which may be in fluid communication with a corresponding nozzle 203. A current pulse may be passed through a heating unit 207 to cause the printing fluid in the chamber to vaporize, causing pressurized ejection of droplets of the printing fluid on the substrate 204. Each heating unit 207 corresponding to a respective nozzle 203 may serve a dual role in that each heating unit 207 may be used both for heating the printing fluid to print the printing fluid from the corresponding nozzle 203, and for heating the printhead 202 to reduce and/or prevent decap. In examples where the printheads 204 are piezo inkjet printheads, heating units 207 such as resistors may be included as well.

The printhead may include a temperature sensor 211, such as a thermal sense resistor (TSR). The temperature sensor 211 may provide temperature feedback during each portion 209 of the print pass 206. The temperature feedback may represent the temperature of the printhead 202 during each portion 209 of the print pass 206.

In some examples, the printheads 202 may be mounted on a carnage that may be movable bi-directionally in an axis perpendicular to the media advance direction 206. In another example the printheads are configured to span the entire width of the media 204 such that the printheads do not need to scan across the print zone 205, in a so-called page-wide array configuration. If the printheads 202 are multiple inkjet printheads, each printhead 202 may be to print with a different coloured printing inks. In some examples, there may be four printheads 202 each to print with one of a type of printing fluid, such as a cyan (C), magenta (M), yellow (Y), or black (K) color ink. In other examples, there may be a single printhead 202 to print each of a type of printing fluid, such as a cyan (C), magenta (M), yellow (Y), or black (K) color ink, such that each nozzle 203 may be dedicated to printing a one of the types of printing fluid. Printing fluid may be supplied to each printhead 202 by a suitable ink supply system.

The operations and methods disclosed herein of the printing system 200 may be implemented and controlled by one or both of a printer controller 210 or by firmware of the printing system 200. In other examples, the operations and methods disclosed herein of the printing system 200 may be implemented by a graphical image editing computer application, a raster image processor (RIP) application, and/or a printer driver, each of which may be running on a computer, laptop, server, or the like. In some examples, the controller 210 may be a hardware component. For example, the controller 210 may be or may include an application-specific integrated circuit (ASIC) or other hardware component. The controller 210 may be a component of a printer or be located external to the printer. The controller 210 may include a processor 212 such as a microprocessor, a microcontroller, a computer processor, or the like. The processor 210 may, for example, include multiple cores on a chip, multiple cores across multiple chips, multiple cores across multiple devices, or combinations thereof. In some examples, the processor 210 may include at least one integrated circuit (IC), other control logic, other electronic circuits, or combinations thereof.

The processor 212 may be in communication with a computer-readable medium 216 via a communication bus 214. The computer-readable medium 216 may include a single medium or multiple media. For example, the computer readable medium may include one or both of a memory of the ASIC, and a separate memory that stores firmware of the printing system 200. The computer readable medium 216 may be any electronic, magnetic, optical, or other physical storage device. For example, the computer-readable storage medium 216 may be, for example, Random Access Memory (RAM), an Electrically Erasable Programmable Read-Only Memory (EEPROM), a storage drive, a CD, a DVD, and the like. The computer-readable medium 216 may be non-transitory. The computer-readable medium 216 may store, encode, or carry computer executable instructions 218 that, when executed by the controller 210, processor 212 or a suitable processing system, may cause the controller 210, processor 212, or the suitable processing system to perform any one or more of the methods or operations disclosed herein according to various examples.

For example, the computer executable instructions 218 may include instructions for determining a drive signal to drive a printhead 202 to each of a series of target temperatures during respective portions 209 of a print pass 206 by the printhead 202. Each of the target temperatures may be the greater of a temperature of the printhead 202 caused by printing a quantity of printing fluid to be printed during the respective portion 209 and a predetermined threshold temperature. The drive signal may be based on a plurality of heating quantities that are determined before printing the print pass 206. The computer-executable instructions 218 may also include instructions for providing the drive signal to warm the printhead 202 to the series of target temperatures while the printhead 202 prints the respective quantities of the printing fluid during the respective portions 209.

Thus, the printing system 200 may comprise a printhead 202 including a plurality of heating units 207 to warm the printhead 202 to a series of target temperatures while the printhead 202 prints respective quantities of the printing fluid during respective portions 206 of a print pass 209. The printing system 200 may comprise a controller 210 to determine a drive signal to drive the printhead 202 to the series of target temperatures. Each of the target temperatures may be the greater of a temperature of the printhead 202 caused by printing the quantity to be printed during the respective portion 209 and a predetermined threshold temperature. A first target temperature of the series of target temperatures may be greater than the threshold temperature, and a second target temperature of the series of target temperatures may be equal to the threshold temperature.

Figure 3:
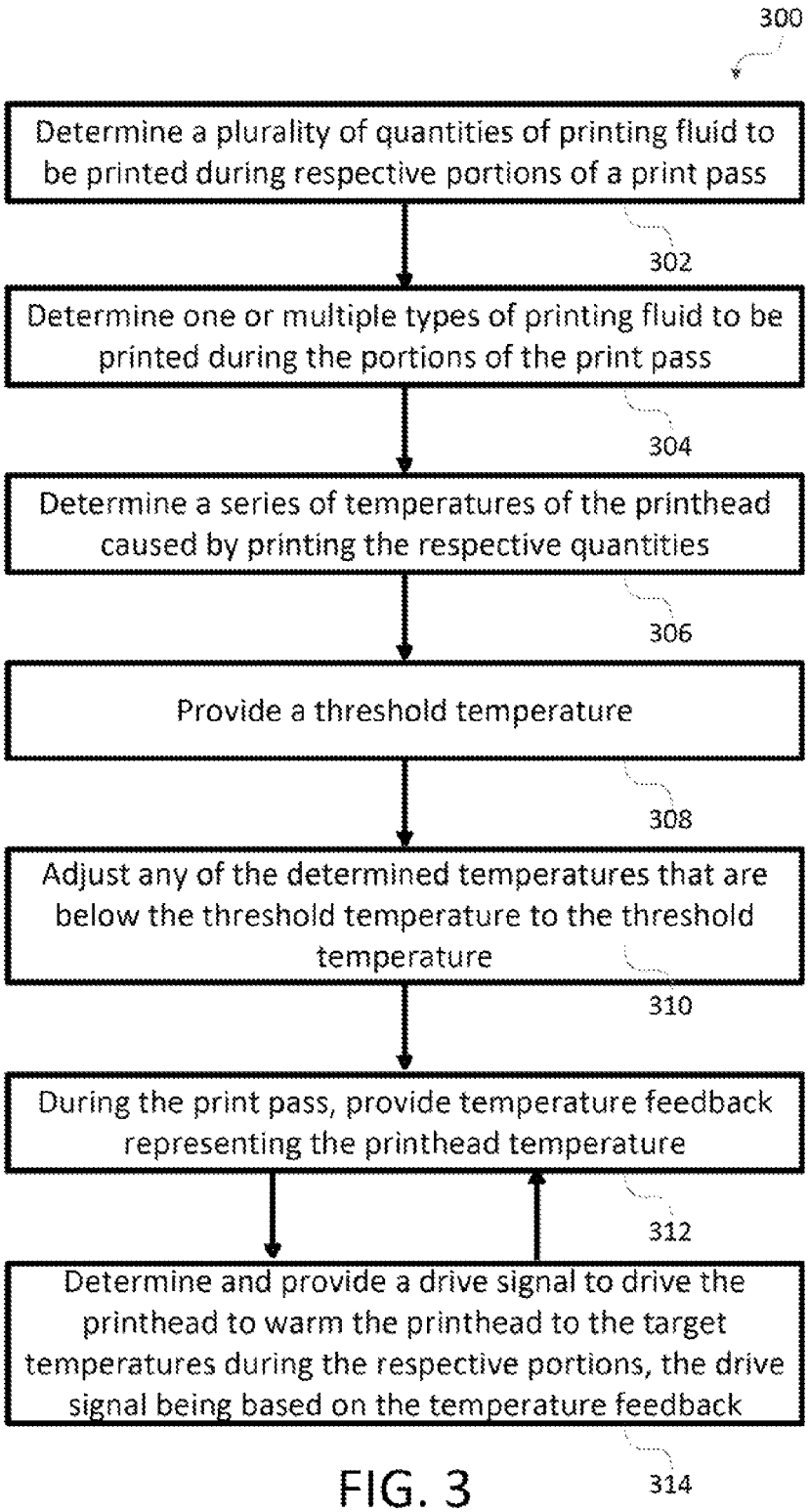
FIG. 3 is a flow diagram illustrating a method of reducing decap of printing fluid according to some examples.

FIG. 3 is a flow diagram illustrating a method 300 of reducing decap of printing fluid according to some examples. In describing FIG. 3, reference to FIGS. 2, 4 and 5 will be made. The ordering of the steps presented herein is in accordance with only some examples of the method 300. The ordering may be varied, such that some steps may occur simultaneously, some steps may be omitted, and further steps may be added.

The method 300 may begin at block 302. One or more of blocks 302, 304, 306, and 308 may be implemented before printing the one or multiple print passes 206. Thus, blocks 302, 304, 306, and 308 may be implemented before a user prints an image on a substrate 204.

At block 302, a plurality of quantities of printing fluid to be printed during respective portions 209 of one or multiple print passes 206 and/or one or multiple print swaths may be provided and/or determined. In some examples, each of the quantities may represent densities of the printing fluid to be printed on an area of the substrate 204 during the respective portion 209. In other examples, each of the quantities may represent absolute amounts of the printing fluid to be printed on an area of the substrate 204 during the respective portion 209. However, in other examples, the quantities may represent values other than densities or absolute amounts of printing fluid.

The method 300 may proceed from block 302 to block 304. At block 304, one or multiple types of printing fluid to be printed by the printhead 202 during the portions 209 may be provided and/or determined. In some examples, each of the types may represent colors of the printing fluid, such as cyan (C), magenta (M), yellow (Y), or black (K) ink, to be printed on an area of the substrate 204 during the one or multiple print passes 206. However, in other examples, the types of the printing fluid may represent properties other than colors of the printing fluid. In some examples, the printhead 202 may print with a single color printing fluid during the print passes 206. In other examples, the printhead 202 may print each color of printing fluid, for example cyan (C), magenta (M), yellow (Y), or black (K) ink.

Taken together, the plurality of quantities and/or types of blocks 302 and 304 may represent an image to be printed by the printhead 202. Thus, an image to be printed by the printhead 202 may be provided and/or determined. The determined quantities and types may be stored in the computer readable medium 216 as image data, such as a printhead control data.

Figure 4:
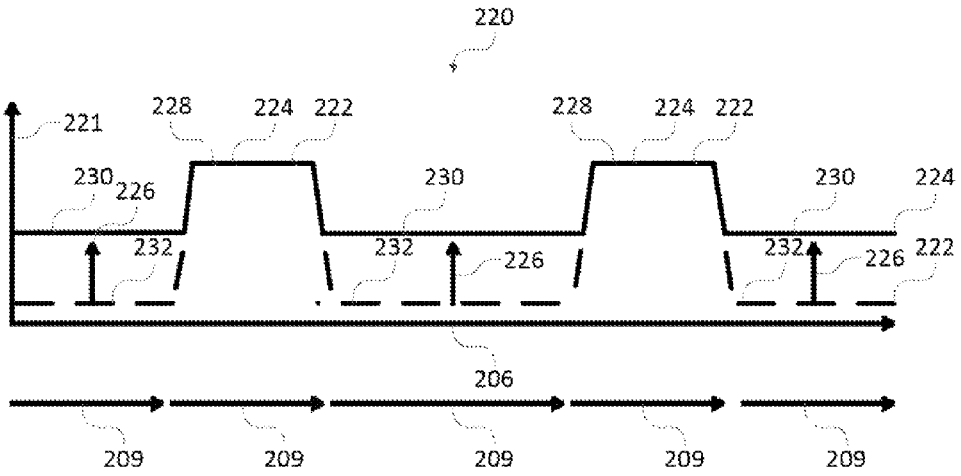
FIG. 4 is a chart illustrating temperature profiles of a print pass according to some examples.

FIG. 4 is a chart 220 illustrating an inherent temperature profile 222 and an adjusted temperature profile 224, each of which may be relationships between temperature 221 shown on the y-axis and a location of the print pass 206 on the x-axis.

Figure 5:
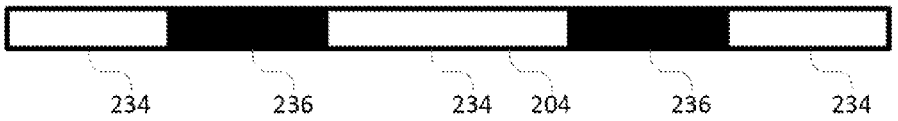
FIG. 5 is a substrate for printing according to some examples.

FIG. 5 illustrates a substrate 204 for printing which may include regions 234 in which a low quantity of printing fluid may be printed, and regions 236 in which a high quantity of printing fluid may be printed. Each of the regions 234 and 236 may correspond to a portion 209 of the print pass 206, as shown.

The method 300 may proceed from block 304 to block 306. At block 306, heating quantities may be provided and/or determined, In some examples, the heating quantities may represent a series of temperatures of the printhead 202 caused by printing the determined respective quantities and/or types of printing fluid during the respective portions 209. In other examples, each of the heating quantities may represent respective voltages, currents, energies, or other quantities that may be applied to heating units 207 to achieve the series of temperatures that may be caused by printing the determined respective quantities. The voltages, currents, energies, or other quantities that may achieve the series of temperatures may depend on physical characteristics of the printhead 202.

Thus, the determination of the heating quantities may be made based on the determined quantities of printing fluid and/or types of printing fluid. The series of temperatures, taken together, may define an inherent temperature profile 222 of the one or multiple print passes 206. A lower temperature 232 may result in printing the regions 234 having a lower quantity of printing fluid during a portion 209, because lower energy of the current pulses generated by the heating units 207 may cause droplets of ejected printing fluid to be smaller in volume. A higher temperature 228 may result in printing the regions 236 having a higher quantity of printing fluid during a portion 209, because higher energy of the current pulses generated by the heating units 207 may cause droplets of ejected printing fluid to be larger in volume.

In some examples, the heating quantities may be predetermined. For example, in prior testing of the printhead 202, the temperature sensor 211 may have provided temperature feedback representing a series of temperatures of the printhead 202 caused by printing any given series of quantities and types of printing fluid during each portion 209. The heating quantities, which may represent the temperatures, voltages, currents, or energies, may be stored in the computer-readable medium 216 in lookup tables that may map each heating quantity such as a temperature to a quantity of printing fluid and/or to a type of printing fluid. Some examples, the lookup tables may map each heating quantity to each of the combinations of a quantity of inkjet and a type of printing fluid that would generate that temperature.

In some examples, each of the heating quantities may be determined by the controller 210 based on the determined respective quantities and/or types of printing fluid, for example by using data stored in the computer-readable medium 216 such as mathematical formulas which may represent how to convert the determined respective quantities and/or types of printing fluid into the heating quantities.

In some examples, a particular temperature of the temperature profile 222 may depend only on the quantity and/or type of printing fluid to be printed during the respective portion 209. In other examples, a particular temperature of the temperature profile 222 may depend both on the quantity and/or type of printing fluid to be printed during the respective portion 209 as well as on the quantities and/or type of printing fluid to be printed in other portions 209, such as a portion 209 immediately previous to the portion 209 for which the particular temperature may be determined and/or stored. For example, the heating of the printhead 202 due to printing the immediately previous quantity and/or type of printing fluid may partially carry over to the temperature of the printhead 202 during the printing of the current quantity and type of printing fluid.

The method 300 may proceed from block 306 to block 308. At block 308, a threshold heating quantity such as a threshold temperature 230 may be provided. The threshold heating quantity may be predetermined and/or stored by the controller 210. The threshold temperature 230 may be a temperature sufficiently high to reduce decap and/or prevent decap of the printing fluid. The threshold temperature 230 may be below a temperature at which overheating of the printhead 202 may occur. In other examples, the threshold heating quantity may be threshold voltages, threshold currents, or threshold energies that may be applied to the heating units 207 that may be sufficiently high to reduce decap and/or prevent decap of the printing fluid.

The method 300 may proceed from block 308 to block 310. At block 310, in response to one or more of the heating quantities such as the temperatures provided at block 306 being below the threshold heating quantity such as the threshold temperature 230, the one or more of the heating quantities such as the temperatures may be adjusted to the threshold heating quantity such as the threshold temperature by adding an additionally heating quantity such as an additional temperature 226, as shown in FIG. 4. Thus, each of the temperatures in the adjusted temperature profile 224 may be equal to or above the threshold temperature 230 The adjustment may increase one or multiple temperatures by, for example, between about 5 and about 20 degrees Celsius, or by about 50%.

In some examples, the heating quantities such as temperatures that may have been adjusted to the heating quantity threshold such as the threshold temperature may be changed in the lookup table. In other examples, a second lookup table may be provided which contains the non-adjusted heating quantities such as the non-adjusted temperatures as well as the adjusted heating quantities such as the adjusted temperatures. The temperatures in the first modified table or the second table may be referred to as target heating quantities such as target temperatures, as these target temperatures may later be used to heat the printhead 202 while printing the respective portions 209.

When printing a region 234 having a low quantity of printing fluid in a portion 209, the ink ejection may generate low energy and a low temperature 232, which may result in decap of the printing fluid. In that case, the adjustment of the low temperature 232 to the threshold temperature 230 may reduce and/or prevent decap. When printing high quantities of printing fluid a portion 209, the ink ejection may generate high energy and a high temperature 228, which may result in low decap or no decap. In that case, no adjustment of the high temperature may be implemented. Because too much additional temperature 226 may compromise the life of the printhead 202, and because the additional temperature 226 of the adjustment may be implemented only if a temperature may be below the threshold temperature 230 and not when the adjustment is not needed in regions 236 having high quantities of printing fluid, the life of the printhead 202 may be optimized.

Thus, at blocks 306 and 308, each of the target heating quantities such as target temperatures may be selected from between a greater of (1) the heating quantities such as the temperature of the printhead 202 caused by printing the quantity and/or type of printing fluid to be printed during the respective portion 209 of the one or multiple print passes 206 and (2) the predetermined threshold heating quantity such as the predetermined threshold temperature 230.

At least a first determined heating quantity or a first plurality of determined heating quantities may be greater than a threshold heating quantity, and at least a second determined heating quantity or a second plurality of determined heating quantities may be equal to the threshold heating quantity. For example, at least a first determined target temperature or a first plurality of determined target temperatures may be greater than the threshold temperature 230, and at least a second determined target temperature or a second plurality of determined target temperatures may be equal to the threshold temperature 230.

The method 300 may proceed from block 310 to blocks 312 and 314. Blocks 312 and 314 may be implemented during the printing the one or multiple print passes 206 as a closed-loop algorithm such as a proportional-integral-derivative (PID) algorithm.

At block 312, the temperature sensor 211 may continuously provide, during each portion 209, temperature feedback that may represent the temperature of the printhead 202 during each portion 209.

The method 300 may proceed from block 312 to block 314. At block 314, a drive signal may be determined and provided by the printer controller 210 to drive the printhead 202 to warm, by the heating units 207, the printhead 202 and this the printing fluid of the printhead 202 to the series of target temperatures during the respective portions 209. The warming may serve dual purposes.

First, the warming may cause the printhead 202, under control of the printer controller 210, to eject drops of printing fluid onto substrate pixel locations on the substrate 204 positioned in the print zone 205 to print the image. During each portion 209, the printhead 202 may print the respective quantity and type of printing fluid by ejecting the printing fluid from suitable nozzles 203 to print the inkjet at the appropriate locations and appropriate densities on the substrate 204. Second, the warming may be used to provide additional heating the printhead 202 to reduce and/or prevent decap without causing undesired ejection of printing fluid.

To accomplish the dual purposes of the warming, each nozzle 203 may be utilized with sufficient frequency such that the time between successive current pulses passed through the nozzle 203 by its heating unit 205 to eject the printing fluid may be less than the decap time of the printing fluid being ejected. For example, the usage of the nozzles 203 may be randomized in such a way that does not affect image to be printed, yet that may ensure that each nozzle 203 is utilized with sufficient frequency, as discussed above. Additionally, in some examples, the additional temperature 226 provided at block 310 may be provided by heating the nozzles 203 according to the randomization scheme described above, or by providing uniformly heating all nozzles 203 of the printhead 202 to provide the additional temperature 226. However, in other examples, nozzles 203 which may not be used during the portion 209 to eject printing fluid may be selectively heated with selective current pulses by their respective heating units 203 to provide the additional temperature 226. The selective current pulses may have insufficient energy to vaporize the printing fluid and thus may have insufficient energy to cause the unused nozzles 203 to eject the printing fluid. Thus, the additional temperature 226 may be provided without causing undesired ejection of printing fluid.

The controller 210 may take into account the temperature feedback obtained at block 312 when providing the drive signal to warm the heating units 207 and this the printing fluid of the printhead 202. Thus, the temperature sensor 211 may provide temperature feedback to allow the heating units 207 to warm the printhead 202 based on the temperature feedback, and such that the drive signal may be based on the temperature feedback.

For example, in response to the heating units 207 unsuccessfully warming the printhead 202 to a correct target temperature by overshooting or undershooting the target temperature, the controller 210 may adjust, e.g. increase or decrease, the amount of heat provided by the heating units 207 such that the printhead 202 and thus the printing fluid of the printhead 202 are warmed to the correct target temperature.

If all print swaths, including all their print passes 206, are completed, then the method 300 may conclude, If all swaths, including all their print passes 206, have not completed, then the method 300 may proceed from block 314 to block 312.

Thus, there have been described examples of printing systems, printers, printheads, computer readable storage media, and methods of reducing decap of the printing fluid by warming the printing fluid during a print pass. In the foregoing description, numerous details are set forth to provide an understanding of the subject disclosed herein. However, examples may be practiced without some or all of these details. Other examples may include modifications and variations from the details discussed above. It is intended that the appended claims cover such modifications and variations.

What is claimed is:

1. A method comprising:

determining a drive signal to drive a printhead to each of a series of target temperatures during respective portions of a print pass by the printhead, each of the target temperatures being the greater of:

a temperature of the printhead caused by printing a quantity of printing fluid to be printed during the respective portion and a quantity of printing fluid to be printed during a previous portion; and a predetermined threshold temperature; and providing the drive signal to warm the printhead to the series of target temperatures during the respective portions of the print pass.

2. The method of claim 1 wherein the quantity of the printing fluid represents a density of the printing fluid to be printed during the respective portion.

3. The method of claim 1 wherein the drive signal is based on a plurality of heating quantities that are determined before printing the print pass.

4. The method of claim 1 wherein a first target temperature of the series of target temperatures is greater than the threshold temperature, and wherein a second target temperature of the series of target temperatures is equal to the threshold temperature.

5. The method of claim 1 wherein the drive signal is based on temperature feedback from a temperature sensor of the printhead.

6. The method of claim 1 wherein the temperature of the printhead being caused by printing the quantity of the printing fluid to be printed during the respective portion comprises the temperature of the printhead being caused by printing the quantity to be printed during the respective portion and by a type of the printing fluid to be printed during the respective portion.

7. The method of claim 6 wherein the type of the printing fluid represents a color of the printing fluid.

8. A non-transitory computer readable storage medium including executable instructions that, when executed by a processor, cause the processor to perform the method of claim 1.

9. The non-transitory computer readable storage medium of claim 8 wherein a first target temperature of the target temperatures is greater than the threshold temperature, and wherein a second target temperature of the predetermined target temperatures is equal to the threshold temperature.

10. The non-transitory computer readable storage medium of claim 8 wherein the drive signal is based on temperature feedback from a temperature sensor of the printhead.

11. The non-transitory computer readable storage medium of claim 8 wherein the temperature of the printhead being caused by printing the quantity of the printing fluid to be printed during the respective portion comprises the temperature of the printhead being caused by printing the quantity to be printed during the respective portion and by a type of the printing fluid to be printed during the respective portion.

12. A printing system comprising:

a printhead including a plurality of heating units to warm the printhead to a series of target temperatures while the printhead prints respective quantities of the printing fluid during respective portions of a print pass; and a controller to perform the method of claim 1.

13. The printing system of claim 12 wherein each of the quantities of the printing fluid represents a density of the printing fluid to be printed during the respective portion.

14. The printing system of claim 12 wherein the plurality of heating units are a plurality of resistors.

15. The printing system of claim 12 further comprising a temperature sensor to provide temperature feedback, the drive signal being based on the temperature feedback.

16. The method of claim 1, further comprising:

determining the plurality of quantities of printing fluid to be printed during respective portions of the print pass, determining a type of printing fluid to be printed during the portions of the print pass;

determining the series of temperatures of the printhead caused by printing the respective quantities; and adjusting any of the determined temperatures that are below the predetermined threshold temperature to above the predetermined threshold temperature.

17. The method of claim 1, wherein providing the drive signal to warm the printhead further comprises:

heating nozzles of the printhead according to a randomization scheme such that the time between successive current pulses passed through the nozzles by corresponding heating units to eject the printing fluid is less than the decap time of the printing fluid at the series of target temperatures during the respective portions of the print pass.

18. The method of claim 1, further comprising:

determining an additional temperature to be adjusted based on a difference between:

the predetermined threshold temperature; and the temperature of the printhead caused by printing the quantity of printing fluid to be printed during the respective portion of the print pass, and causing heating of the printhead with the additional temperature by:

uniformity heating nozzles of the printhead;

randomly using the nozzles of the printhead at a frequency such that the additional temperature is produced; or selectively heating nozzles determined to not eject printing fluid during the printing pass.

19. The method of claim 1, wherein the providing the drive signal to warm the printhead to the series of target temperatures further comprises:

selectively heating nozzles of the printhead with selective current pulses by corresponding heating units to provide a temperature difference between the predetermined temperature; and the temperature of the printhead caused by printing the quantity of printing fluid to be printed during the respective portion of the print pass.

* * * * *